United States Patent [19]

Pratt

[11] Patent Number: 4,809,366

[45] Date of Patent: Mar. 7, 1989

[54] WRISTBAND AND INTEGRAL BACK OF HAND PAD

[75] Inventor: Michael J. Pratt, Park City, Utah

[73] Assignee: Ogio International, Inc., Salt Lake City, Utah

[21] Appl. No.: 140,607

[22] Filed: Jan. 4, 1988

[51] Int. Cl.[4] ..... A41D 19/00

[52] U.S. Cl. ..... 2/170; 2/20; 2/161 R; 2/161 A; 2/162

[58] Field of Search ..... 2/16, 17, 20, 161 R, 2/161 A, 162, 170; 66/174

[56] References Cited

U.S. PATENT DOCUMENTS

| | | | |
|---|---|---|---|
| 1,451,949 | 4/1923 | Haseltine | 2/162 |
| 1,594,151 | 7/1926 | Chance | 2/16 |
| 1,790,381 | 1/1931 | Keller | 2/20 X |
| 2,643,389 | 6/1953 | Wegner | 2/170 |
| 2,769,179 | 11/1956 | Love | 2/161 A |
| 3,066,306 | 12/1962 | Thomas | 2/20 |
| 3,421,160 | 1/1969 | Domenico | 2/159 |
| 3,486,171 | 12/1969 | Zierhut | 2/159 |
| 3,726,525 | 4/1973 | Jackson | 2/161 A X |
| 4,067,063 | 1/1978 | Ettinger | 2/16 |
| 4,068,318 | 1/1978 | McMahon | 2/170 |
| 4,441,711 | 4/1984 | Dubar et al. | 2/161 A |
| 4,499,741 | 2/1985 | Harris | 213/207 |

*Primary Examiner*—Werner H. Schroeder
*Assistant Examiner*—Jeanette E. Chapman
*Attorney, Agent, or Firm*—Thorpe, North & Western

[57] ABSTRACT

A combination wristband and back of the hand flap or pad for absorbing and wiping perspiration from the forehead and face of the wearer comprises a circumferential wristband made of an absorbent, fabric material which is elastic and stretchable in a circumferential direction. A flap or pad extends from one end of the wristband, with the flap or pad being an integrally formed extension of the wristband and made of the same absorbent, stretchable, fabric material as the wristband. The flap or pad lies substantially flatwise against the back of one's hand when the wristband is being worn.

9 Claims, 2 Drawing Sheets

WRISTBAND AND INTEGRAL BACK OF HAND PAD

BACKGROUND OF THE INVENTION

1. Field of the Invention

The present invention relates generally to stretchable, fabric articles used as wrist sweatbands. In particular, the invention relates to a combination of a wrist sweatband made of an absorbent fabric which is elastic and stretchable in a circumferential direction, with an associated flap formed of the same absorbent material extending from the wristband to lie against the back of one's hand.

2. State of the Art

Numerous, specialized gloves and wristbands have been disclosed in the prior art for use in various athletic endeavors. A patent search developed the following U.S. patents which are relevant to the present invention:

Harris, U.S. Pat. No. 4,499,741, issued 2/19/1985, McMahon, U.S. Pat. No. 4,068,318, issued 1/17/1978, Jackson, U.S. Pat. No. 3,726,525, issued 4/10/1973, Zierhut, U.S. Pat. No. 3,486,171, issued 12/30/1969, Domenico, U.S. Pat. No. 3,421,160, issued 1/14/1969, Love, U.S. Pat. No. 2,769,179 issued 11/6/1956, Keller, U.S. Pat. No. 1,790,381, issued 1/27/1931, Chance, U.S. Pat. No. 1,594,151, issued 7/27/1926.

The prior art, as represented by the above-identified U.S. patents, discloses sweatbands for placement about the wrist of the user and used to absorb perspiration from the brow of the wearer when wiped with the sweatband. It is common during tennis tournaments to see a player with a wristband on each arm using the wristbands almost constantly to remove perspiration from his or her face. The surface areas of the wristbands are limited and are often not satisfactory. Specialized gloves are also disclosed which incorporate a wristband support and extensions extending over the backhand or forehand of the user. These extensions are for the purpose of supporting the hand or fingers of the user. There is no suggestion in the prior art of a wristband and an integral pad extension made of an absorbent material, wherein the pad lies against the back of the wearer's hand and can be used as an addition to the wristband to wipe perspiration from the wearer's forehead and face.

3. Objectives

A principal objective of the present invention is to provide a novel combination of a wrist sweatband and an integrally attached sweat pad for wiping perspiration from the head and face of the wearer. A particular objective of the present invention is to provide a novel combination of a wristband and an integrally formed flap or pad extending from the wristband, wherein the wristband and flap or pad are made of an absorbent material which is elastic and stretchable in a circumferential direction and further wherein the flap or pad lies against the back of one's hand when the wristband is worn about one's wrist, such that the wristband and the flap or pad of material can be used to wipe perspiration from the wearer's forehead and face.

BRIEF DESCRIPTION OF THE INVENTION

The above objectives are achieved in accordance with the present invention by providing a novel combination of a wristband and back of the hand pad or flap which is integrally attached to the wristband. The wristband and the flap or pad are formed from an integral piece of absorbent, fabric material which comprises an annular wristband portion having a flap or pad extending from one end thereof. The fabric from which the wristband and flap or pad is formed is elastic and stretchable in a circumferential direction with respect to the annular, wristband portion. When the wristband is worn on one's wrist, with the end thereof from which the flap or pad portion extends facing the wearer's hand, the pad or flap lies substantially flatwise against the back of the wearer's hand. The wristband and the flap or pad of material can be used, in a convenient motion of the back of the hand of the wearer, to wipe perspiration from the wearer's forehead and face.

Additional objects and features of the invention will become apparent from the following detailed description, taken together with the accompanying drawings.

THE DRAWINGS

A preferred embodiment of the present invention representing the best mode presently contemplated of carrying out the invention is illustrated in the accompanying drawings in which:

FIG. 1 a is pictorial representation of a novel, combination wrist sweatband and back of the hand pad in accordance with the present invention;

DETAILED DESCRIPTION OF THE ILLUSTRATED EMBODIMENT

Figure 1:
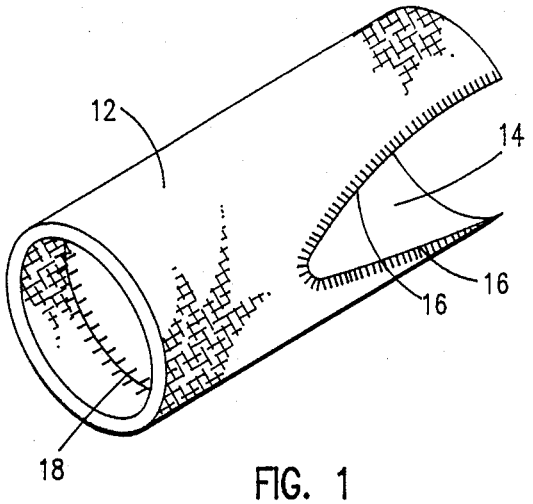

As illustrated in the drawings, the combination wristband and back of the hand pad or flap comprises an annular wristband portion 12 which is made of an absorbent, fabric material. The fabric material is preferably of the type which is elastic and stretchable in a circumferential direction, such that the wristband 12 can expand to fit over the hand 50 (FIG. 5) of a user and then fit snugly on the wrist and end of the arm 52 of the user. A knitted terry cloth material which is elastic and stretchable is especially preferred. A flap or pad portion 14 extends from one end of the wristband portion 12. The pad portion 14 is an integrally formed extension of the same absorbent, stretchable, fabric material as the wristband portion 12. The pad portion 14 lies substantially flatwise against the back of one's hand when the wristband is being worn (see FIG. 5). The elastic nature of the wristband 12 and the pad 14 have been found to be especially effective in retaining the pad 14 in a closely spaced, glove-like position on the backhand of the person wearing the device. The device can be inconspicuously worn and does not interfere in any manner with the wearer's normal use of his hand. The device is effective when used in sports activities of all kinds and is particularly effective for sports such as tennis and handball. The device absorbs perspiration from the arm of the wearer, but is most effective in that the wearer can use both the wristband and the pad on the back of his hand to quickly and effectively wipe perspiration from his or her face and forehead.

In the preferred embodiment, as illustrated in the drawings, the wristband 12 and the flap or pad 14 are formed from an integral, elongate, tubular piece of fabric. The tubular piece of fabric is advantageously made by conventional knitting techniques which produce elongate, tubular items. The knitted fabric is preferably terry cloth, and elastic, threadlike members are knitted into the fabric in a circumferential direction about the tubular member, such that the tubular member is elastic and stretchable in a circumferential direction about the tubular member.

The flap or pad 14 is formed from the knitted, tubular piece of fabric by making an elongate, generally arch-shaped cut out which extends longitudinally inwardly from one end of the tubular piece of fabric. The one end portion of the tubular piece of fabric adjacent to the cut out forms the flap or pad 14, and the remaining, tubular other end portion of the piece of fabric forms the wristband 12. Advantageously, the cut out has a width in the circumferential direction of said tubular piece of fabric which is less than one-half the circumferential dimension of said tubular piece of fabric in its unextended, nonstretched condition. In addition, the internal end of the cut out is preferably arcuate in shape so as to be rounded inwardly toward the other end of the tubular piece of fabric. The cut edge of the cut out portion of the tubular piece of fabric is preferably finished with a hem stitch 16 to form a finished edge. The flap or pad 14 has been found to retain a position lying closely adjacent to the backhand of the wearer of the present device. The flap or pad 14 conforms closely t^G^G^G^Ge shape of the backhand of the wearer much like a glove. It is believed that the profound capability of the flap or pad 14 to conform and lie closely adjacent to the backhand of the wearer is at least partially the result of the tubular, elastic nature of the fabric from which the device is made and the integrally formed relationship between the flap or pad portion 14 and the tubular wristband portion 12. When the tubular wristband portion 12 of the device is stretched to expand over the wrist of the wearer, the flap or pad portion 14 of the device is biased into a generally inwardly curved shape, such that the flap or pad 14 curves around the backhand of the wearer to form a closely spaced, glove-like fit.

Figure 2:
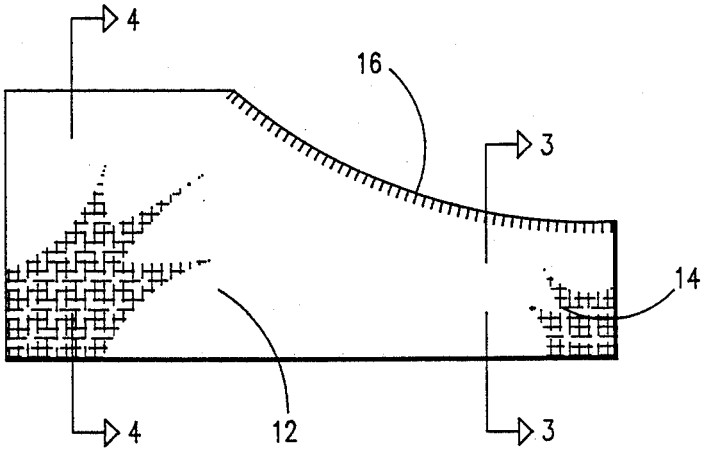
FIG. 2 is a longitudinal side view of the sweatband and back of the hand pad of FIG. 1.
Figure 3:
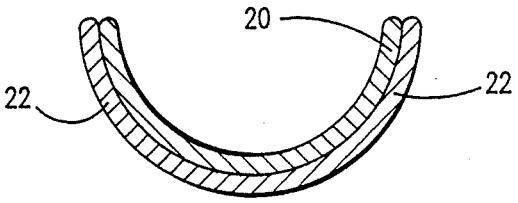
FIG. 3 is a transverse cross section taken along line 3—3 of FIG. 2.
Figure 4:
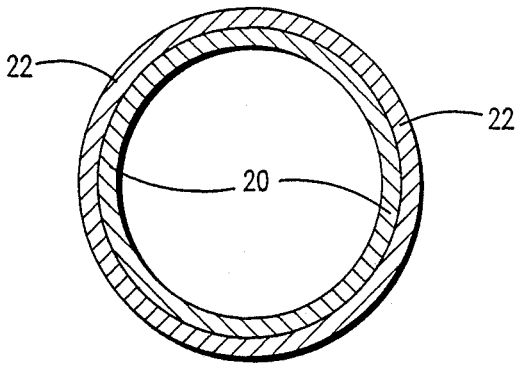
FIG. 4 is a transverse cross section taken along line 4—4 of FIG. 2.
Figure 5:
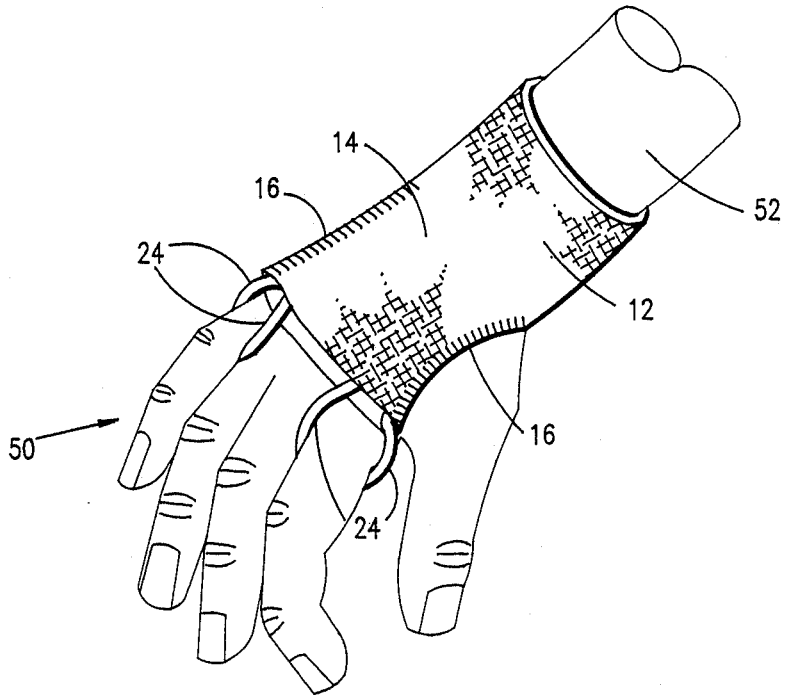
FIG. 5 is a pictorial of the right hand of a person showing the wristband and back of the hand pad in proper position on the wrist and the back of the hand of the wearer.

In a particularly preferred embodiment of the invention, the combination wristband and back of the hand pad are formed from an integral, elongate, tubular piece of fabric which has been turned back at its opposite ends so that the opposite ends of the tubular piece of fabric meet to form a double walled, tubular member having folded, finished ends. As shown in FIGS. 3 and 4, the turned back portion of the tubular piece of fabric forms the inner wall 20 of the double walled, tubular member, and the portion of the tubular pieced of fabric which is not turned back forms the outer wall 22 of the double walled, tubular member. The turned back opposite ends of the tubular piece of fabric meet along the inner wall of the double walled, tubular member, and the abutting ends are preferably joined together by a hem stitch 18 as shown in FIG. 1. When the arch shaped cut out is formed in the double walled, tubular member, the cut side edges of the double walls of the tubular member, are stitched together with a hem 16 such as shown in FIGS. 1, 2 and 5.

Although not being essential, elastic loops 24 can be provided in the free end of the flap or pad portion 14, with the loops 24 being adapted to engage one or more fingers of the wearer. As illustrated in FIG. 5, the loops 24 can be positioned at the opposite end corners of the free end of the flap or pad 14, such that the loops engage the index finger and the little finger, respectively, of the wearer. As explained previously, the flap or pad 14 of the device of this invention has the natural tendency to lie closely adjacent to the backhand of the wearer, such that generally no such finger engagement means similar to the loops 24 are necessary. However, in some applications, it may by desirable to incorporate such finger engagement means, and it is intended that the scope of the invention would cover such finger engagement means.

Although a preferred embodiment of the combination wristband and back of the hand flap or pad of the present invention has been illustrated and described, it is to be understood that the present disclosure is made by way of example and that various other embodiments are possible without departing from the subject matter coming within the scope of the following claims, which subject matter is regarded as the invention.

I claim:

1. A combination wristband and back of the hand pad for absorbing and wiping perspiration from the forehead and face of the wearer, said combination comprising a circumferential wristband;

a pad extending from one end of said wristband, such that said pad lies substantially flatwise against the back of one's hand when the wristband is being worn;

said wristband and pad being formed from an integral, elongate, tubular piece of fabric, wherein the fabric is an absorbent material which is elastic and stretchable in a circumferential direction; and an elongate, generally arc-shaped cut out extends longitudinally inwardly from one end of said tubular piece, such that the one end portion of the tubular piece adjacent to the cut out forms said pad and the remaining, tubular, other end portion of said piece of fabric forms said wristband.

2. The combination wristband and back of the hand pad in accordance with claim 1, wherein said cut out has a width in the circumferential direction of said tubular piece of fabric which is less than one-half the circumferential dimension of said tubular piece of fabric.

3. The combination wristband and back of the hand pad in accordance with claim 1, wherein the internal end of said cut out is arcuate in shape.

4. The combination wristband and back of the hand pad in accordance with claim 1 wherein the opposite ends and of said tubular piece are turned back upon the tubular piece so that the opposite ends meet to thereby form a double walled, tubular member having folded, finished ends;

said elongate, generally arch-shaped cut out extends longitudinally inwardly from one of the finished ends of said double walled, tubular member, with, the edges of the cut out being sewn to form a finished edge.

5. The combination wristband and back of the hand pad in accordance with claim 4, wherein said cut out has a width in the circumferential direction of said double walled, tubular member which is less than one-half the circumferential dimension of said double walled, tubular member.

6. The combination wristband and back of the hand pad in accordance with claim 4, wherein the internal end of said cut out is arcuate in shape.

7. A method of making a combination wristband and back of the hand pad for absorbing and wiping perspiration from the forehead and face of the wearer, said method comprising making an integral, elongate, generally tubular piece of fabric from an absorbent, fabric material which is elastic and stretchable in a circumferential direction;

tuning back the opposite ends of said tubular piece of fabric upon itself such that the opposite ends meet to thereby form a double walled, tubular member having folded, finished ends;

cutting an elongate, generally arch-shaped cut out extending longitudinally inwardly from one of the finished ends of said double walled, tubular member; and sewing the edges of the cut out in said double walled, tubular member to form finished edges therealong; whereby the one end portion of the double walled, tubular member adjacent to the cut out forms said pad and the remaining, tubular, other end portion of said double walled, tubular member forms said wristband.

8. The method of making a combination wristband and back of the hand pad in accordance with claim 7, wherein said cut out has a width in the circumferential direction of said double walled, tubular member which is less than one-half the circumferential dimension of said double walled, tubular member.

9. The method of making a combination wristband and back of the hand pad in accordance with claim 7, wherein the internal end of said cut out is arcuate in shape.

* * * * *